United States Patent [19]

Aoki

[11] 4,158,347

[45] Jun. 19, 1979

[54] FUEL SUPPLY SYSTEM FOR USE IN INTERNAL COMBUSTION ENGINE

[75] Inventor: Keiji Aoki, Susono, Japan

[73] Assignee: Toyota Jidosha Kogyo Kabushiki Kaisha, Aichi, Japan

[21] Appl. No.: 765,379

[22] Filed: Feb. 3, 1977

[30] Foreign Application Priority Data

Apr. 28, 1976 [JP] Japan ..... 51-47847

[51] Int. Cl.[2] ..... F02M 7/00

[52] U.S. Cl. ..... 123/32 EE; 123/32 EA

[58] Field of Search ..... 123/32 EE, 32 EA, 32 EG

[56] References Cited

U.S. PATENT DOCUMENTS

| | | | |
|---|---|---|---|
| 3,738,341 | 6/1973 | Loos | 123/32 EA |
| 3,745,768 | 7/1973 | Zechnall et al. | 123/32 EE |
| 3,759,232 | 9/1973 | Wahl et al. | 123/32 EE |
| 3,815,561 | 6/1974 | Seitz | 123/32 EE |
| 3,831,564 | 8/1974 | Schmidt et al. | 123/32 EE |
| 3,900,012 | 8/1975 | Wahl et al. | 123/32 EE |
| 3,919,983 | 11/1975 | Wahl et al. | 123/32 EE |
| 3,926,154 | 12/1975 | Williams | 123/32 EE |
| 3,949,551 | 4/1976 | Eichler et al. | 123/32 EE |

*Primary Examiner*—Charles T. Jordan

*Attorney, Agent, or Firm*—Stevens, Davis, Miller & Mosher

[57] ABSTRACT

A fuel supply system for use in an internal combustion engine equipped with a three way catalytic converter which reduces the amount of $NO_x$ and oxidizes CO and HC at the same time, for controlling air fuel ratio by using an electronic circuit. According to this fuel supply system, when the internal combustion engine is in the low load running mode, the air fuel ratio of the mixture charge to be supplied to the engine is increased. In addition, when cooling water in the internal combustion engine remains above a given temperature and the load of the engine is over a given level, then the mixture charge is maintained at an increased air fuel ratio (a lean mixture charge) rather than at the stoichiometric air fuel ratio. In addition, there is provided means for slowing down a transient phase from the stoichiometric air fuel ratio to the increased air fuel ratio or vice versa.

11 Claims, 5 Drawing Figures

FUEL SUPPLY SYSTEM FOR USE IN INTERNAL COMBUSTION ENGINE

BACKGROUND OF THE INVENTION

1. Field of the Invention

This invention relates to a fuel supply system for use in an internal combustion engine, and more particularly, to a fuel supply system which may provide a mixture charge of increased air fuel ratio, as compared with the stoichiometric air fuel ratio, in case the engine remains in a low load running mode. In addition, the present invention is further associated with a fuel supply system which increases the air fuel ratio of a mixture charge, when cooling water temperature and the load of an engine exceed given levels, respectively, and slows down transient phase from the stoichiometric air fuel ratio to the increased air fuel ratio or vice versa.

2. Description of the Prior Art

SAE papers 730005 and 730566 teach that harmful constituents of exhaust gases may be removed by means of a three way catalytic converter which may convert into an innocuous form, the three harmful emissions, such as nitrogen oxides (NOx), unburnt hydrocarbon (HC) and carbon-monoxide (CO) at the same time, while maintaining the air fuel ratio of a mixture charge in the proximity of the stoichiometric air fuel ratio.

In addition, U.S. Pat. Nos. 3,738,341 and 3,759,232 disclose fuel supply systems which measure the air fuel ratio of a mixture charge, based on the oxygen concentration of exhaust gases, and produce a signal to thereby control, to a desired level, the air fuel ratio of the mixture charge to be supplied to the engine according to the aforesaid signal representing the air fuel ratio measured.

With the prior art internal combustion engines having the aforesaid three way catalytic converter, when an engine is in a low load running mode such as idling, engine braking or steady running mode, with a throttle value maintained almost closed, considerable amounts of CO and HC are produced according to the operational characteristics of the engine. In addition, since a small amount of fuel is supplied to the engine at the time of low load running thereof, the air fuel ratio tends to vary due to minor changes in the condition of the air which is being supplied to the engine or changes in other running conditions. Accordingly, the prior art internal combustion engines fail to remove CO and HC to the extent desired.

The three-way converter poses a problem in that the desired catalytic action may only be achieved for a mixture charge of an air fuel ratio in a quite narrow range around the stoichiometric air fuel ratio. Accordingly, the prior art fuel supply systems fail to provide a lean mixture charge in case the temperature of cooling water in the engine is above a given level and the load on the engine exceeds a given level.

SUMMARY OF THE INVENTION

It is an object of the present invention to provide a fuel supply system for use in an internal combustion engine, which increases the air fuel ratio of the mixture charge (lean mixture charge) to be supplied to the engine in the aforesaid low load running mode of the engine so as to enhance the converting capability of a three-way catalyst for CO and HC, by utilizing the phenomenon that little or no $NO_x$ is produced in the low load running mode of an engine.

It is another object of the present invention to provide a fuel supply system of the type described, which may increase the air fuel ratio of a mixture charge to be supplied to the engine, when the temperature of the cooling water in the engine is above a given temperature level and the load on the engine exceeds a given level, thereby reducing the fuel consumption of the engine.

It is a further object of the present invention to provide a fuel supply system of the type described which may maintain the mixture charge at a stoichiometric air fuel ratio when the engine is run at a low temperature or under a low load.

According to a first aspect of the present invention, there is provided a fuel supply system for use in an internal combustion engine, which comprises: means for providing a mixture charge of increased air fuel ratio, as compared with a stoichiometric air fuel ratio, when said engine is in a low load running mode.

According to a second aspect of the present invention, there is provided a fuel supply system for use in an internal combustion engine wherein the air fuel ratio of a mixture charge may be maintained at a stoichiometric air fuel ratio according to a signal fed back from an air fuel sensor, comprising means for maintaining the air fuel ratio of a mixture charge at a lean or increased air fuel ratio, when the temperature of cooling water in the engine is over a given level, and means for gradually effecting the shifting from the stoichiometric air fuel ratio of the mixture charge to the lean or increased air fuel ratio, or vice versa.

DESCRIPTION OF THE PREFERRED EMBODIMENTS

Figure 1:
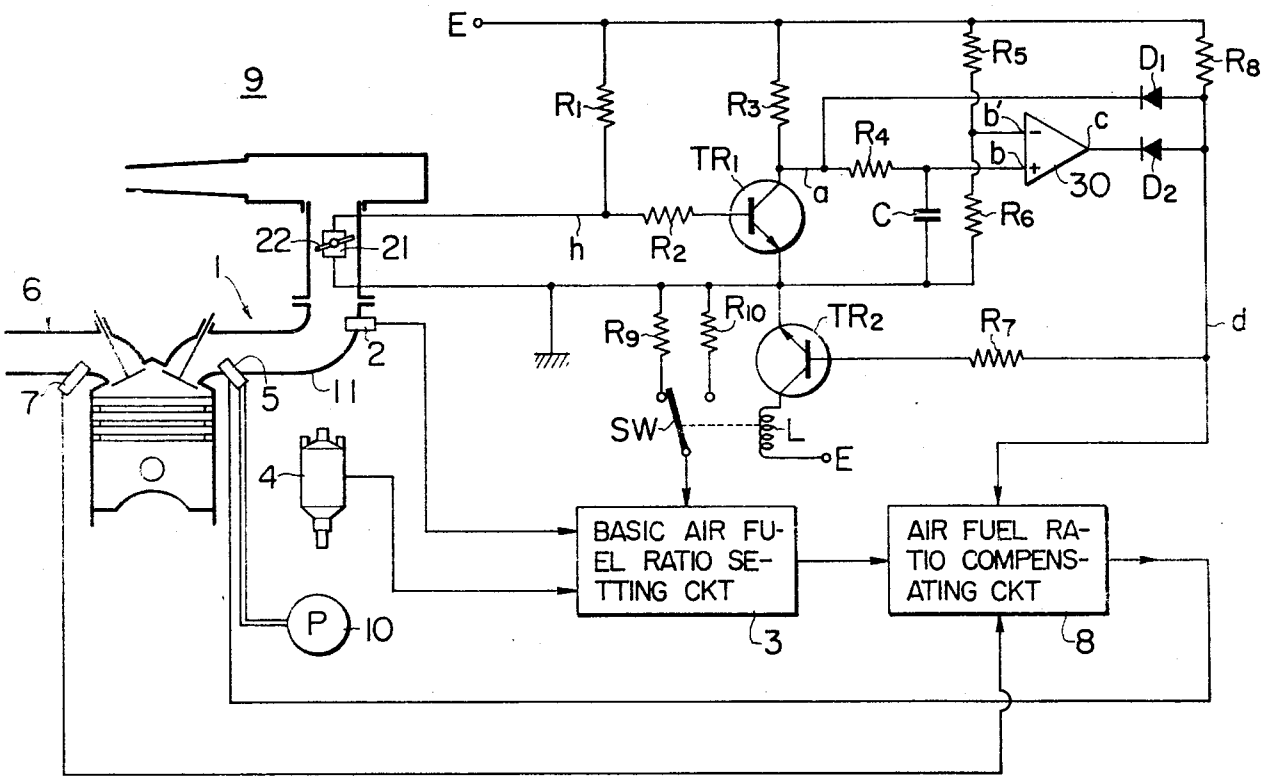
FIG. 1 is a schematic view of a first embodiment of the present invention.
Figure 2:
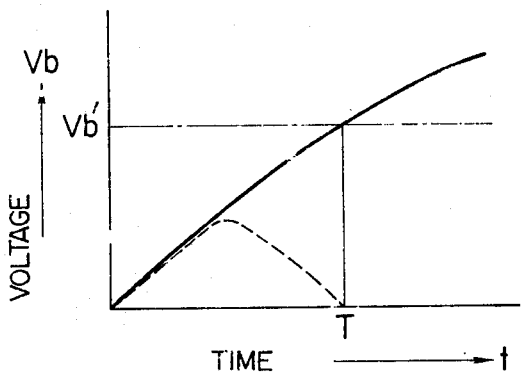
FIG. 2 is a plot showing the relationship between time and voltage appearing at a non-inverting input terminal of a comparator.
Figure 3:
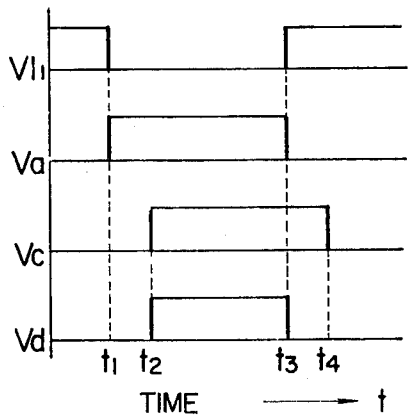
FIG. 3 is a pulse diagram showing the relationship between time and voltages.

FIGS. 1 to 3 refer to the first embodiment of the present invention, in which the air fuel ratio is increased at the time of low load running of the engine.

Referring now to FIG. 1, there is shown an intake system at 1.

A flow rate sensor 2 is provided in the intake system 1 for converting the flow rate of intake air into an electric signal which in turn is fed to a basic air fuel ratio setting circuit 3.

An ignition distributor 4 generates a pulse signal representing the r.p.m. of an engine, based on the on-off cycles of primary electric current flowing through an ignition coil, thereby feeding a pulse signal to the basic air fuel ratio setting circuit 3.

The basic air fuel ratio setting circuit 3 determines a temporary open duration of an injection valve 5 according to these signals from the flow rate sensor 2 and the ignition distributor 4.

An air fuel ratio sensor 7 is provided in an exhaust system 6 and consists of a fuel cell having a solid electrolyte. The sensor 7 detects the actual air fuel ratio of the exhaust gases for converting same into an electric signal which in turn is fed to an air fuel ratio compensating circuit 8.

The air fuel ratio compensating circuit 8 compensates for the temporary open duration of the injection valve 5, which duration has been determined by the basic air fuel ratio setting circuit 3, according to the electrical signal from the air fuel ratio sensor 7.

The basic air fuel ratio setting circuit 3 and the air fuel ratio compensating circuit 8 are described in detail in AUTOMOTIVE ELECTRONICS II editted by SAE in February, 1975. The injection valve 5 is opened or closed according to a signal from the air fuel ratio compensating circuit 8. Thus, fuel is fed from an injection pump 10 to the injection valve 5 for injection into an intake manifold 11 during the time in which a pulse is being fed to the injection valve 5.

A throttle switch 21 cooperates with a throttle valve 22 and is closed when the throttle valve 22 is open to an extent smaller than a given angle, and is opened when the throttle valve 22 is open to an extent greater than the aforesaid given angle. The aforesaid given angular opening is dependent on the $NO_x$-emitting characteristic of the engine. One end of the throttle switch 21 is connected by way of a base register R1 to a terminal E of a D.C electric power source, and by way of a base resistor R2 to the base of an NPN transistor TR1.

A collector of the transistor TR1 is connected by way of a collector resistor R3 to the electric power source terminal E, while the emitter of the transistor TR1 is grounded.

One end of a condenser C is connected by way of a resistor R4 to the collector of the transistor TR1, while the other end of the condensor C is grounded. Shown at a is a collector terminal of the transistor TR1.

The condenser C and the resistor R4 constitute an integrating circuit. The other end of the condenser C is connected to a non-inverting input terminal b of a comparator 30.

Resistors R5 and R6 are connected in series between the electric power source terminal E and the ground, and serve to maintain a voltage at an inverting input terminal b' of the comparator 30 at a given set voltage level.

An emitter of an NPN transistor TR2 is grounded, while a base of the transistor TR2 is connected by way of base resistors R7 and R8 to the electric power source terminal E. In addition, a collector of the transistor TR2 is connected by way of a coil L to the electric power source terminal E. A junction d between the base resistor R7 and the resistor R8 is connected by way of a diode D1 to the collector terminal a of the transistor TR1 and by way of a diode D2 to an output terminal c of the comparator 30. The diodes D1 and D2 serve as an AND circuit.

A change-over switch SW is grounded by way of a resistor R9, when the coil L is de-energized. However, when the coil L is energized, the switch SW is attracted by the coil L and is grounded by way of a resistor R10. The resistances of the resistors R9 and R10 are different from each other.

A signal, representing which one of the resistors R9 or R10 the switch SW is connected to, is fed to the basic air fuel ratio setting circuit 3.

A voltage signal is fed from the junction d between the resistors R7 and R8 to the air fuel ratio compensating circuit 8.

In operation, when the throttle switch 21 remains in its open position, the base voltage of the transistor TR1 is positive, and the transistor TR1 is conducting. Accordingly, voltage Va at the collector terminal a remains at the zero level, so that voltage Vb at the input terminal b of the comparator 30 remains at the zero level. As a result, voltage Vc at the output terminal c of the comparator 30 remains at the zero level, while voltage of a forward direction is impressed on diodes D1 and D2, so that voltage Vd at the junction d remains at the zero level. In other words, the transistor TR2 is non-conducting and the coil L is not energized, while the switch SW is connected to the side of the resistor R9.

The basic air fuel ratio setting circuit 3 senses the condition of the switch SW. The basic air fuel ratio setting circuit 3 computes the open duration of the injection valve 5 so as to provide a mixture charge of a stoichiometric air fuel ratio for an internal combustion engine 9, thereby feeding an electric signal to the air fuel compensating circuit 8. The air fuel ratio compensating circuit 8 compensates for the open duration of the injection valve 5 according to a signal fed back from the air fuel ratio sensor 7, thereby feeding a signal to the injection valve 5.

The air fuel ratio of a mixture charge, when the opening of the throttle valve 22 is smaller than a given angle, will be described hereunder.

Possible modes of the engine, with the throttle valve 22 open to an extent less than the given angle, are considered to be as follows:

(1) The internal combustion engine is in an engine-brake condition;

(2) The internal combustion engine is in an idling condition (a warmed-up condition of the engine or an idling condition for example at the time of standing at a crossing);

(3) The accelerator pedal is released for changing gears for acceleration.

In either case, the throttle switch 21 remains in its closed position, so that the voltage at a junction between the resistors R1 and R2 remains at the zero level, and the transistor TR1 remains non-conducting. Then, the voltage Vb at the input terminal b of the comparator 30 is temporarily increased by means of the condenser C. However, in condition (3) above, the duration of time in which the throttle switch 21 is maintained open is short, so that, as shown by a broken line in FIG. 2, the voltage Vb at the input terminal b of the comparator 30 is again brought back to the zero level, rather than increasing to a level higher than the voltage Vb' at the inverting terminal of the comparator 30. Accordingly, the voltage Vc at the output terminal c of the comparator 30 will not remain positive.

In the conditions (1) and (2) above, the duration of time in which the throttle switch 21 is closed exceeds a given value T. As a result, as shown by a solid line in FIG. 2, the voltage Vb at the non-inverting input terminal b of the comparator 30 goes above the voltage Vb'. As shown in FIG. 3, the voltage Vc at the output terminal c of the comparator 30 will be turned positive at the time t2, i.e., a given period of time T after the voltage Vh at the junction h has been turned to the zero level, simultaneously with the closing of the throttle switch 21 at the time t1. When the voltages at the terminals a and c are both turned to the high level, then the diodes D1 and D2 become non-conducting, so that the voltage Vd at the junction d will be turned to positive. The positive voltage Vd at the junction d is impressed on the base of the transistor TR2 to bring the same into a conducting condition, and thus the coil L will be energized. As a result, the switch SW is attracted by the coil L and is closed on the side of the resistor R10. Then, the basic air fuel ratio setting circuit 3 senses the aforesaid condition of the switch SW. At the same time, the air fuel ratio compensating circuit 8 detects a variation in voltage Vd at the junction d. Then, the basic air fuel ratio setting circuit 3 computes an open duration of the injection valve 5 so as to provide for the engine 9 a mixture charge having an air fuel ratio greater than a stoichiometric air fuel ratio, thereby feeding a signal to the air fuel ratio compensating circuit 8. The air fuel ratio compensating circuit 8 interrupts a feedback signal from the air fuel ratio sensor 7. Thus, a signal for providing an air fuel ratio greater than a stoichiometric air fuel ratio may be fed from the basic air fuel ratio setting circuit 3 to the injection valve 5, without being compensated for by the air fuel ratio compensating circuit 8. Accordingly, the mixture charge being fed to the internal combustion engine 9 at this time will be leaner.

When the opening of the throttle valve 22 becomes greater than the aforesaid given angle by shifting from the conditions (1) and (2) above, the transistor TR1 becomes conducting at the time t3. The voltage Vb at the input terminal b of the comparator 30 is discharged by way of the resistor R4, so that the voltage Vb at the non-inverting input terminal b of the comparator 30 is lowered, as compared with the voltage Vb' at the inverting input terminal b' at the time t4 which is after the time t3. However, the voltage Vd at the junction d is a logical product of signals at the terminals a and c, so that the voltage Vd at the junction becomes zero from the time t3 on. In other words, the switch SW is closed on the side of the resistor R9, the moment the opening of the throttle valve 22 becomes greater than a given angle, so that the air fuel ratio of a mixture charge may be feedback-controlled for a stoichiometric air fuel ratio.

As is apparent from the foregoing description, when the internal combustion engine remains in a low load running condition, i.e., when the throttle valve is maintained below a given opening for a relatively long period of time, a lean mixture charge may be supplied to the internal combustion engine. As a result, the amount of harmful constituents of the exhaust gases and fuel consumption may both be reduced. In addition, as in this embodiment, the voltage at the junction d is a logical product of signals at the terminals a and c, so that when the throttle valve is opened again, the air fuel ratio of a mixture charge may be brought back to a stoichiometric air fuel ratio without delay. Still futhermore, when the throttle valve is closed for a quite short period of time, as in the case of changing gears, the air fuel ratio may be maintained at the stoichiometric air fuel ratio, and the lowering in capability of catalyst to reduce the amount of $NO_x$, after changing gears, may be prevented. The present invention may be applied to an internal combustion engine having a carburetor.

Description will now be turned to the second embodiment of the present invention, wherein the air fuel ratio of a mixture charge is increased, when the temperature of cooling water in the internal combustion engine is above a given level and yet a load on the internal combustion engine is over a given level.

Figure 4:
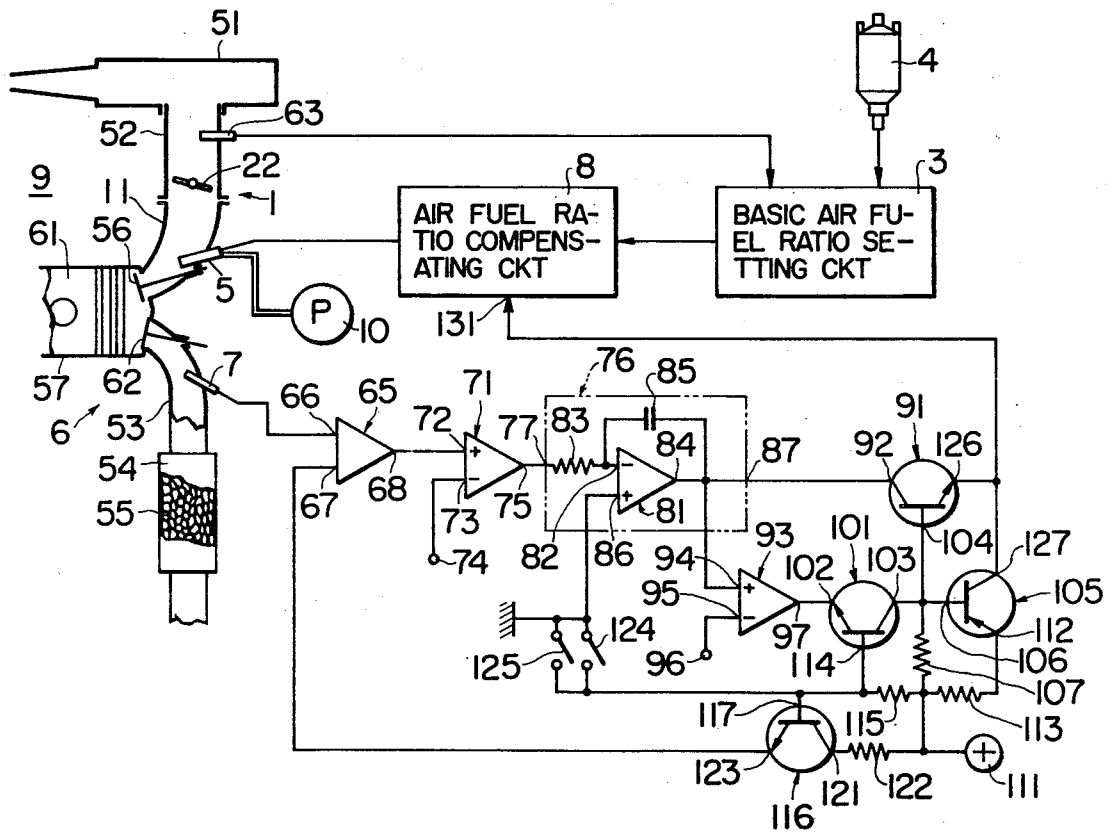
FIG. 4 is a schematic view of a second embodiment of the invention.
Figure 5:
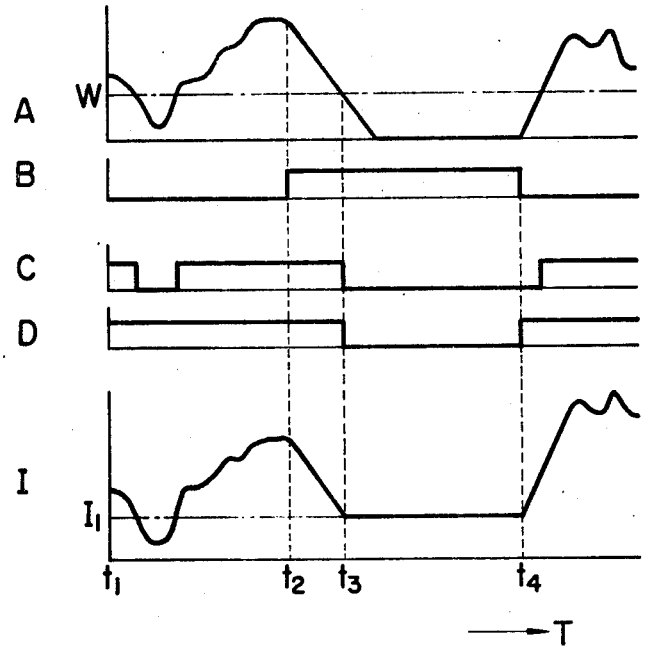
FIG. 5 is a plot showing signal wave forms at respective terminals of the second embodiment.

FIGS. 4 and 5 refer to the second embodiment of the invention.

Referring to FIG. 4, there is shown an intake system at 1. The intake system 1 consists of an air cleaner 51, an intake pipe 52 and an intake manifold 11. Shown at 53 is an exhaust pipe. Provided in the exhaust pipe 53 is a three-way catalytic converter 54, in which three-way catalyst 55 is housed therein for reducing or oxidizing harmful constituents of exhaust gases, i.e., $NO_x$, HC and CO, at the same time. Shown at 22 is a throttle valve, at 56 an intake valve, at 61 a piston, and at 62 an exhaust valve.

In the second embodiment, a flow rate sensor 63 is provided in the intake pipe 52 between the air cleaner 51 and the throttle valve 22, for measuring the total flow rate of air being supplied to the respective cylinders of the internal combustion engine 9. An injection valve 5 is provided in each pipe of the intake manifold 11 leading to each cylinder of the engine.

The open duration of the injection valve 5 is controlled according to the pulse width of an electric signal fed, and the injection valve 5 may inject fuel under pressure into the respective cylinders of an engine.

The basic air fuel ratio setting circuit 3 has an input terminal connected to the flow rate sensor 63 and a contact breaker of the ignition distributor 4, and an output terminal connected to an input terminal of an air fuel ratio compensating circuit 8. The basic air fuel ratio setting circuit 3 receives information associated with the intake air flow rate from the flow rate sensor 63, and information associated with r.p.m. of an engine from the contact breaker of the ignition distributor 4. The basic air fuel ratio setting circuit 3 computes an open duration of the injection valve 5 which is required for providing a mixture charge of stoichiometric air fuel ratio, based on that information, thereby feeding a pulse, having a width corresponding to the aforesaid open duration of the injection valve 5, to the air fuel ratio compensating circuit 8.

An air fuel ratio sensor 7 is provided in an exhaust pipe 53 in which exhaust gases from the respective cylinders are joined together. The air fuel ratio sensor 7 detects the concentration of oxygen contained in exhaust gases, and generates a low level voltage (referred to hereinafter as "0") when oxygen remains in the exhaust gases, i.e., when the mixture charge is lean. The sensor 7 generates a high level voltage (referred to hereinafter as "1"), when oxygen is no longer present in exhaust gases, i.e., when the mixture charge is rich.

The air fuel ratio sensor 7 is connected to an input terminal 66 of an adder 65. The adder 65 generates an output voltage associated with the sum of voltages appearing at the input terminals 66, 67, while the output terminal 68 is connected to a non-inverting terminal 72 of a comparator 71. An inverting terminal 73 of the comparator 71 is connected to a terminal 74 having a reference potential of a lever 'U'. The comparator 71 serves to provide an output wave-form for the adder 65. An output terminal 75 of the comparator 71 is connected to an input terminal 77 of an integrator 76. The integrator 76 consists of an operational amplifier 81, a resistor 83 connected to an inverting terminal 82 of the operational amplifier 81, and a condenser 85 provided between the inverting terminal 82 and an output terminal 84 of the operational amplifier 81. A non-inverting terminal 86 of the operational amplifier 81 is grounded. An output terminal 87 of the integrator 76, i.e., the output terminal 84 of the operational amplifier 81, is connected to a collector 92 of a NPN type transistor 91. The output terminal 84 of the operational amplifier 81 is connected to a non-inverting terminal 94 of the comparator 93. The inverting terminal 95 of the comparator 93 is connected to a voltage terminal 96 having a reference voltage of a level "W". An output terminal 97 of the comparator 93 is connected to an emitter 102 of a NPN type transistor 101. A collector 103 of the transistor 101 is connected to a base of the transistor 91 and a base 106 of a PNP transistor 105. A collector 103 of the transistor 101 is connected by way of a resistor 107 to an electric power source 111. An emitter 112 of the transistor 105 is connected by way of a resistor 113 to the electric power source 111. A base 114 of the transistor 101 is connected by way of a resistor 115 to the electric power source 111 and to a base 117 of a NPN transistor 116. A collector 121 of the transistor 116 is connected by way of a resistor 122 to the electric power source 111, while an emitter 123 of the transistor 116 is connected to the input terminal 67 of the adder 65. A water temperature switch 124 is provided between the base 114 of the transistor 101 and the ground. The water temperature switch is mounted on a water jacket for sensing the temperature of the internal combustion engine 9.

The water temperature switch 124 closes its contacts when the internal combustion engine remains at a low temperature, and opens its contacts when the internal combustion engine 9 is at a warmed-up temperature. A vacuum switch 125 is secured to the intake manifold 11 downstream of the throttle valve 22 for detecting a load of the engine 9.

The vacuum switch 125 closes its contacts when the load of the engine is below a given value, i.e., at the time of low load running of the engine 9, and opens its contacts when the load of the engine is over a given value, i.e., at the time of medium and high load running of the engine. An emitter 126 of the transistor 91 is connected to the collector 127 of the transistor 105 and to the input terminal 131 of the air fuel ratio compensating circuit 8.

The air fuel ratio compensating circuit 8 compensates for a signal of a pulse width from the basic air fuel ratio setting circuit 3 by a signal fed to the input terminal 131, thereby feeding a signal thus compensated to the injection valve 5.

Operation of the fuel supply system according to the present invention will be described in more detail by referring to FIG. 5. Shown at A in FIG. 5 is the voltage at the output terminal 87 of the integrator 76; at B, the voltage at the base 114 of the transistor 101; at C, the output voltage of the comparator 93; at D, the voltage at the base 104 of the transistor 91; and at I, the current to be supplied to the input terminal 131 of the air fuel ratio compensating circuit 8. Represented by the abscissa is time T.

(a) In case the internal combustion engine is at a low temperature or under a low load, i.e., during a period from the time t1 to the time t2:

Either the water temperature switch 124 or the vacuum switch 125 remains in its closed position, and B remains at 0. Accordingly, transistors 101 and 116 maintain their open condition, while the transistor 91 remains in its closed condition. Since an input signal is not fed to the input terminal 67 of the adder 65, the adder 65 receives a signal "1" or "0" from the air fuel ratio sensor 7 to feed same to the integrator 76 by way of the comparator 71. Since the transistor 91 is closed, the output voltage A of the integrator 76 is impressed on the input terminal 131 of the air fuel ratio compensating circuit 8. In other words, during the period from the time t1 to the time t2, the input current I being fed to the input terminal 131 is proportional to the output voltage A of the integrator 76. During the period from the time t1 to the time t2, the comparator 93 compares the output voltage A at the integrator 76 with the reference voltage W, thereby generating an output signal "1" or "0", while the transistor 101 remains in its open condition, so that the above output signal exerts no influence on the input current I. During this period, the air fuel ratio compensating circuit 8 compensates for the output signal from the basic air fuel ratio setting circuit 3 according to a signal fed back from the air fuel ratio sensor 7, thereby feeding a signal to the injection valve 5, with the result that the mixture charge being supplied to the engine 9 may be maintained substantially at a stoichiometric air fuel ratio.

(b) When the engine is at a warmed-up temperature and yet under medium or high load, i. e., during the period from the time t2 to the time t4:

The water temperature switch 124 and vacuum switch 125 are both opened, and the voltage B at the base 114 of the transistor 101 remains at "1". Accordingly, both the transistor 101 and the transistor 116 remain in their closed condition, the voltage at the input terminal 67 of the adder 65 remains at "1", and the voltage D at the base 104 of the transistor 91 remains equal to the output voltage C of the comparator 93. The period (b) is further divided into two periods (b1) and (b2).

(b1) When the output voltage A of the integrator 76 is higher than the reference voltage "W", i.e., during the period from the time t2 to the time t3:

The output voltage C at the comparator 93 remains at "1", so that the transistor 91 stays in the closed condition, and the transistor 105 maintains the open condition. The adder 65 treats the voltage "1" impressed on the input terminal 67 in similar manner as the voltage "1" (a signal representing a super-rich mixture charge) fed from the air fuel ratio sensor 7, so that a signal "1" is impressed by way of the comparator 71 on the input terminal of the integrator 76. Accordingly, the output voltage A at the integrator 76 is lowered at a given gradient.

The voltage which is thus being lowered is impressed by way of the transistor 91 on the input terminal 131 of the air fuel ratio compensating circuit 8, so that the open duration of the injection valve 5 is gradually reduced, thereby providing a mixture charge which is made gradually leaner.

(b2) When the output voltage A at the integrator 76 is lower than the reference voltage W, i.e., during the period from the time t3 to the time t4:

The output C at the comparator 93 becomes "0", so that the output C, "0", is transmitted by way of the transistor 101 to the base 104 of the transistor 91. As a result, the transistor 91 will be turned into an open condition, while the transistor 105 will be turned into a closed condition. Thus, a given current $I_1$ is supplied from the electric power source 111 by way of the resistor 113 and transistor 105 to the input terminal 131 of the air fuel ratio compensating circuit 8. As a result, the open duration of the injection valve 5 is maintained over a given value, so that the air fuel ratio of the mixture will not be lowered more than is required.

(c) When the internal combustion engine 9 is brought to a low temperature condition or a low load condition after the condition (b), i.e., the period after the time t4:

A voltage at the base 117 of the transistor 116, i.e., the voltage B, is turned into "0", while the transistors 117 and 101 are brought to an open condition. Accordingly, the adder 65 transmits only an output signal from the air fuel ratio sensor 7 by way of the comparator 71 to the input terminal 77 of the integrator 76. The output voltage A at the integrator 76 is gradually increased. As a result, the current being supplied to the input terminal 131 of the air fuel ratio compensating circuit 8 is gradually increased, while the air fuel ratio of the mixture charge is gradually shifted to the stoichiometric air fuel ratio, and eventually becomes equal to the latter, thereby effecting the feedback control as in the previous condition (a).

As is apparent from the foregoing description, when the internal combustion engine 9 remains at a warmed-up temperature and under a load exceeding a given load level, the mixture charge may be maintained in a given lean or increased air fuel ratio. In addition, the air fuel ratio of a mixture charge may be gradually shifted from the stoichiometric air fuel ratio to a given increased air fuel ratio. This may not only reduce fuel consumption but also permit the shifting of the air fuel ratio from one level to another, without impairing the stability of operation of the internal combustion engine.

Meanwhile, when the mixture charge is lean, the catalytic efficiency of a three-way catalyst will be reduced. However, combustion of a lean mixture charge results in smaller amounts of CO, HC, $NO_x$, leaving no problem in treatment of the exhaust gases.

While the present invention has been described herein with reference to certain exemplary embodiments thereof, it should be understood that various changes, modifications and alterations may be effected without departing from the spirit and the scope of the present invention as defined in the claims.

What is claimed is:

1. A fuel supply system for use in an internal combustion engine, said system comprising:

means for supplying to the engine a fuel mixture charge of increased air fuel ratio, as compared with the stoichiometric air fuel ratio, when the engine is in a low load running mode;

an injection valve for adjusting the flow rate of fuel to be supplied to the engine;

first means for detecting the air fuel ratio of exhaust products from the engine;

second means for computing the flow rate of fuel to be supplied to the engine to produce a fuel mixture charge of stoichiometric air fuel ratio and for feeding an output to the injection valve;

third means for generating an output in accordance with the position of a throttle valve in an intake manifold;

fourth means for integrating the output of said third means;

fifth means for comparing an output of said fourth means with a reference signal;

sixth means for switching an output of said second means into an output corresponding to an air fuel ratio larger than the stoichiometric air fuel ratio in association with outputs of said third means and said fifth means;

said sixth means comprises a seventh means for logically producing an output of said third means and an output of said fifth means; and eighth means for switching from one resistor to another in association with an output of said seventh means; and said second means comprises:

a basic air fuel ratio setting circuit for computing the flow rate of fuel to be supplied to produce a fuel mixture charge equal to or larger than the stoichiometric air fuel ratio in association with an output of said eighth means, and an air fuel ratio compensating circuit for compensating an output of said basic air fuel ratio setting circuit by said first means in association with said seventh means or for interrupting compensation upon feeding an output to said injection valve.

2. A fuel supply system for an internal combustion engine, said system comprising:

an intake system comprising a throttle valve therein;

an injection valve through which an adjusted flow rate of fuel is supplied to the engine from a source of fuel;

first means for detecting the air fuel ratio of exhaust products from the engine;

second means for computing the flow rate of fuel to be supplied to the engine and for feeding an output to the injection valve;

third means for generating an output in accordance with the position of the throttle valve in the intake system, said third means comprises:

a throttle switch operatively associated with said throttle valve, said switch being closed when said throttle valve is at an angle less than a predetermined angle and being open when said throttle valve is at an angle greater than said predetermined angle; and a transistor having a base electrically connected to said throttle switch;

fourth means for integrating the output of said third means and for generating an output in accordance with the integration;

fifth means for comparing the output of said fourth means with a reference signal and for generating an output in accordance with the comparison; and sixth means for switching said second means to produce an output corresponding to an air fuel ratio for the fuel mixture to be supplied to the engine which is greater than the stoichiometric air fuel ratio in accordance with the output of said third means and the output of said fifth means.

3. A fuel supply system as claimed in claim 2, wherein:

said fourth means comprises a condenser and a resistor electrically connected in series; and said fourth means is electrically connected in parallel to said transistor of said third means.

4. A fuel supply system as claimed in claim 3, wherein:

said fifth means comprises a comparator.

5. A fuel supply system as claimed in claim 4, wherein:

said sixth means comprises:

a seventh means for logically producing an output in accordance with the output of said third means and the output of said fifth means; and an eighth means for switching from one position to another in accordance with the output of said seventh means.

6. A fuel supply system as claimed in claim 5, wherein:

said second means comprises:

a basic air fuel ratio setting circuit for computing a flow rate of fuel to be supplied to produce a fuel mixture charge equal to the stoichiometric air fuel ratio when said eighth means is in one switched position and for computing a flow rate of fuel to be supplied to the engine to produce a fuel mixture charge greater than the stoichiometric air fuel ratio when said eighth means is in the other switched position; and an air fuel ratio compensating circuit for compensating the output of said basic air fuel ratio setting circuit by said first means or for interrupting compensation in accordance with the output of said seventh means.

7. A fuel system as claimed in claim 6, wherein:

said seventh means comprises:

a first diode electrically connected in series to and between said transistor of said third means and said air fuel ratio compensating circuit; and a second diode electrically connected in series to and between said comparator and said air fuel ratio compensating circuit.

8. A fuel supply system as claimed in claim 7, further comprising:

a first resistor having a given resistance electrically connected to ground;

a second resistor having a resistance other than said given resistance electrically connected to ground; and said eighth means comprises a second switch movable in response to energization of a coil, said second switch being electrically connected in series to and between said first resistor and said basic air fuel ratio setting circuit when said second switch is in said one switched position and being electrically connected in series to and between said second resistor and said basic air fuel ratio setting circuit when said second switch is in said other switched position.

9. A fuel supply system for a liquid cooled internal combustion engine, said system comprising:

an injection valve through which an adjusted flow rate of fuel is supplied to the engine from a source of fuel;

first means for generating an output signal in accordance with the air fuel ratio of exhaust products from the engine;

second means for computing the flow rate of fuel to be supplied to the engine and for feeding an output signal to the engine;

third means for generating an output signal in accordance with the temperature of cooling liquid in the engine and the load on the engine;

fourth means for generating an output signal by integrating a logical sum of the output signal of the first means and the output signal of the third means;

fifth means for transmitting the output signal of said fourth means or a signal of predetermined magnitude to said second means in accordance with the temperature of the cooling liquid in the engine and the load thereon;

said second means comprises:

a basic air fuel ratio setting circuit; and an air fuel ratio compensating circuit;

said fifth means is electrically connected to said air fuel ratio compensating circuit;

said third means comprises:

a first switch which is closed when the temperature of engine cooling liquid is below a predetermined temperature and is open when the temperature of engine cooling liquid is above said predetermined temperature; and a second switch which is closed when the load on the engine is below a predetermined amount and is open when the load on the engine is above said predetermined amount; and said first and second switches are electrically connected to and between said fourth means and said fifth means.

10. A fuel supply system as claimed in claim 9, wherein:

said fourth means comprises an adder, a comparator, and an integrator electrically connected in series;

said adder being electrically connected to said first means; and said integrator being electrically connected to said fifth means.

11. A fuel supply system as claimed in claim 10, further comprising:

a source of electrical power; and said fifth means comprises:

a first transistor having a base, an emitter, and a collector, the collector being electrically connected to the integrator, the emitter being electrically connected to the air fuel ratio compensating circuit, and the base being electrically connected to the electrical power source;

a second transistor having a base, an emitter and a collector, the base of said second transistor being electrically connected to the source of electrical power and the first and second switches, the collector of said second transistor being electrically connected to the electrical power source and to the base of the first transistor;

a third transistor having a base, an emitter, and a collector, the base of said third transistor being electrically connected to the electrical power source, to the base of said first transistors, and to the collector of said second transistor, the emitter of said third transistor being electrically connected to the electrical power source, the collector of said third transistor being electrically connected to the air fuel compensating circuit; and a comparator electrically connected to and between the integrator and the emitter of the second transistor.

* * * * *

UNITED STATES PATENT AND TRADEMARK OFFICE

CERTIFICATE OF CORRECTION

PATENT NO. : 4,158,347

DATED : June 19, 1979

INVENTOR(S) : Keiji AOKI

It is certified that error appears in the above-identified patent and that said Letters Patent are hereby corrected as shown below:

Page 1, left column, item [30], Foreign Application Priority Data, should read:

April 28, 1976 [JP] Japan . . . . . .51-47847

October 25, 1976 [JP] Japan. . . . . .51-127363

Signed and Sealed this

*Twenty-sixth* Day of *February 1980*

[SEAL]

*Attest:*

SIDNEY A. DIAMOND

*Attesting Officer*

*Commissioner of Patents and Trademarks*